United States Patent [19]

Krueger

[11] 4,420,736

[45] Dec. 13, 1983

[54] HEATING AND COOLING THERMOSTAT WITH LIMITING ACTION SELECTED BY A SINGLE LEVER CHANGEOVER SWITCHING APPARATUS

[75] Inventor: James H. Krueger, Plymouth, Minn.

[73] Assignee: Honeywell Inc., Minneapolis, Minn.

[21] Appl. No.: 334,407

[22] Filed: Dec. 24, 1981

[51] Int. Cl.[3] ..... H01H 37/22

[52] U.S. Cl. ..... 337/340; 236/1 C; 337/360

[58] Field of Search ..... 236/1 C; 337/340, 360, 337/361

[56] References Cited

U.S. PATENT DOCUMENTS 4,243,967 1/1981 Frank ..... 337/340

4,349,807 9/1982 Gustafson ..... 337/360

*Primary Examiner*—William H. Beha, Jr.

*Attorney, Agent, or Firm*—Clyde C. Blinn

[57] ABSTRACT

A thermostat for controlling heating and cooling apparatuses has a temperature control point adjustment knob connected to a temperature responsive switch means for adjusting the control point thereof. A single lever changeover switch is connected to the temperature responsive switch for selectively connecting either heating or cooling apparatus to the temperature responsive switch. Temperature control point limit stops are connected to the temperature control point adjustment. Upon selecting by the single lever changeover switch either a heating or a cooling operation, the temperature control point limit stops limit the movement of the temperature control point adjustment to a first range of movement when heating is selected and a second range of movement when cooling is selected.

7 Claims, 4 Drawing Figures

HEATING AND COOLING THERMOSTAT WITH LIMITING ACTION SELECTED BY A SINGLE LEVER CHANGEOVER SWITCHING APPARATUS

BACKGROUND AND SUMMARY OF THE INVENTION

Limiting the temperature for comfort and energy conservation by means of a space or room thermostat has been done for many years. In thermostats making use of separate adjusting levers for heating and for cooling operation, the limiting action is quite simple in that a stop is used for the heating lever and a stop is used for the cooling lever, and these stops can be independently set at a fixed position.

In thermostats where a single control point adjusting knob is used, such as in the Carl G. Kronmiller U.S. Pat. No. 2,729,719, issued Jan. 3, 1956, which may have a subbase for switching the thermostat between heating and cooling apparatus such as in the Walter E. Edelman U.S. Pat. No. Re. 28,676, issued Jan. 13, 1976, the single control point adjustment means must have stops that are only used in either the heating or cooling operation. One particular thermostat for accomplishing such a limiting action is disclosed in the Donald P. Kolbow U.S. Pat. No. 4,078,601, issued Mar. 14, 1978. The Kolbow thermostat has a single control point adjustment knob with separate ranges for heating and cooling operation. Such a thermostat has the disadvantage that the control point adjustment knob can be inadvertently placed in the OFF position, and the homeowner would not be aware that his system was completely off. Another thermostat disclosed in the Richard E. Fitzgerald, et al., U.S. Pat. No. 4,249,155, issued Feb. 3, 1981, has a single control point adjustment knob with a changeover lever for switching the thermostat between heating and cooling apparatus. The limit means includes a separate cooling button or heating button which must be operated with the changeover lever to accomplish the limiting action. Such a thermostat is complicated to operate and requires more parts increasing its production cost.

The present invention is concerned with a thermostat having a single lever changeover switch means which selects the limiting action of the thermostat depending upon whether the single control point adjustment knob is to be used in the heating or cooling range of operation. During the heating operation, a first range of operation is selected, and during the cooling operation, a second range of operation is selected. With such an invention, when the single lever is moved to provide a heating mode of operation, a maximum temperature such as 72° F. is provided, and when the single lever is moved to the cooling mode of operation, a minimum temperature such as 78° F. for cooling is provided.

DESCRIPTION OF THE DRAWING

FIG. 3 is the rear view looking in the direction toward FIG. 2, and FIG. 4 is the front view. Each of the FIGS. 3 and 4 disclose the removable tab.

DESCRIPTION OF THE PREFERRED EMBODIMENT

Figure 1:
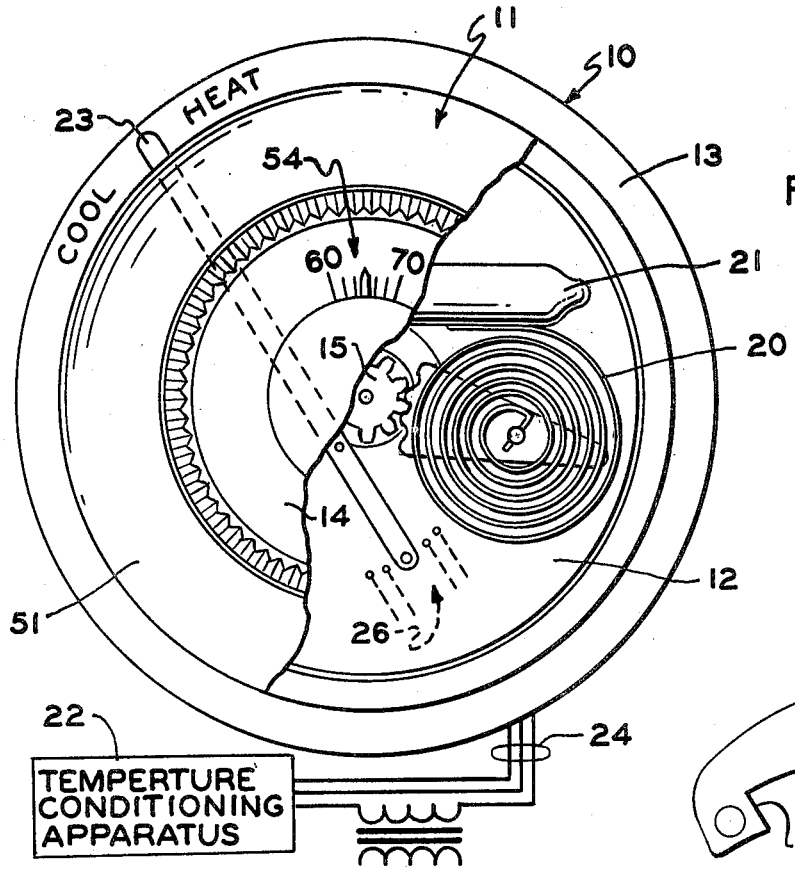
FIG. 1 is a cutaway view of a thermostat having a single control point adjustment knob and a single lever for switching the thermostat operation between heating and/or cooling operation mode.

Referring to FIG. 1, thermostat 10 is made up of a main portion 11 having a base 12 and a subbase 13. The thermostat has a single control point adjustment knob 14 which is connected on a shaft 15 attached to base 12. By the adjustment of knob 14, the control point of a temperature responsive element or bimetal 20 is adjusted to control the operation of a control apparatus or switch 21 as disclosed in the mentioned Kronmiller patent.

When the main portion of the thermostat 11 is to be used to control heating or cooling apparatus 22, subbase 13 is added and attached to base 12 to make a base member which has a single lever 23 for operating switching apparatus 26 to connect switch 21 to either heating or cooling apparatus over the wire connection 24 depending on whether heating or cooling operation is desired. Such a thermostat switching operation is disclosed in the mentioned Edelman, et al., patent.

Figure 2:
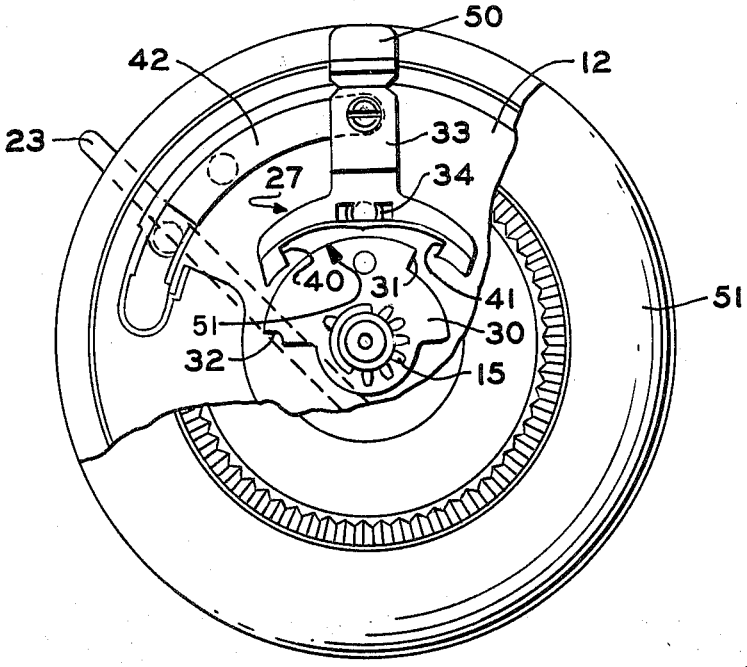
FIG. 2 is a cutaway view of the thermostat of FIG. 1 showing the pivoted limit means associated with the stops connected to the control point adjustment knob to provide the limiting operation depending upon the operation of the single changeover lever.

Referring to FIG. 2, a limit means 27 for the thermostat is shown. Attached to shaft 15 is a stop member 30 having three stop surfaces, 31, 32 and 51. A pivoted stop member 33 pivots about an axis 34 connected to the base 12. Depending upon the position of member 33, a pair of stop surfaces 40 and 41 are selectively positioned to engage one or the other of the stop surfaces 31 and 32 associated with the control point adjustment knob 14. When either of the stop surfaces of member 30 are used to engage stop surfaces 40 or 41 of member 33, stop surface 51 of member 30 is positioned adjacent to the other stop on member 33 to prevent movement of the pivotal member 33, link 42 and switch lever 23 to the heating or cooling position depending on the range of operation selected with the set point means 14.

Member 33 is connected by a link member 42 to single changeover switch lever 23 mounted on the subbase so that upon movement of lever 23 to either the cooling selection or heating selection position, member 33 is pivoted about its axis 34.

Member 33 has a removable tab 50 which, when the cover 51 of the thermostat is in place, the tab holds member 33 in a center or neutral position in which the stops 40 and 41 do not engage the stops 31 and 32. In this position, control point adjustment knob 14 is free to be moved and single changeover switch lever 23 is held in the OFF position. When the installer installs the thermostat, tab 50 is broken off to allow the thermostat limiting means to operate properly.

Figure 3:
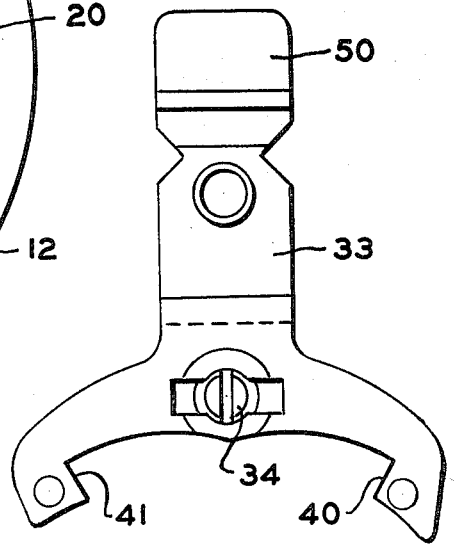
FIGS. 3 and 4 are views of the pivoted member of the limiting means.
Figure 4:
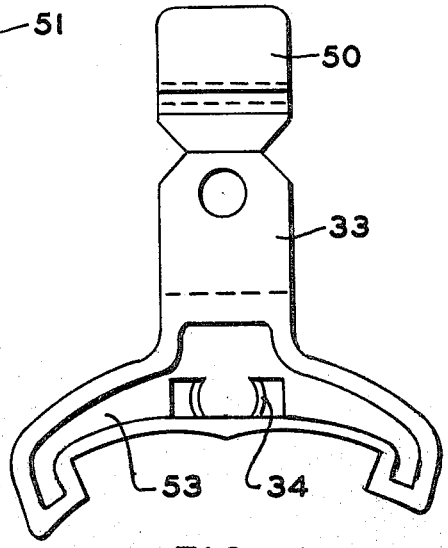

The detail of member 33 is shown in FIGS. 3 and 4. FIG. 3 discloses the removable tab 50 and pivotal connection 34 which is inserted into a hole in base 12 of the thermostat for providing the pivotal movement of member 33. Stops 40 and 41 engage the stops of member 30 shown in FIG. 2. As shown in FIG. 4, a portion of member 33 is recessed at 53 to reduce the size and weight of the member.

DESCRIPTION OF THE OPERATION OF THE PREFERRED EMBODIMENT

With the thermostat 10 connected to heating and cooling apparatus 22 as shown in FIG. 1, the temperature control point or temperature desired in the space is selected by moving single knob 14 having an index and pointer at 54 to select the appropriate temperature to be controlled. Upon moving lever 23 to either the heating (HEAT) or cooling (COOL) position, switch means 26 in the subbase connects the temperature responsive switch 21 to either the heating or cooling apparatus over the connections 24.

At the same time, upon movement of lever 23 as shown in FIG. 2, member 33 is moved either clockwise or counterclockwise, depending upon which direction lever 23 is moved, to position stops 40 or 41 in a position to engage either stop 32 or 31. Thus, during the cooling operation, member 33 is moved to the left about pivot 34 and with the control point adjustment knob 14 turned above some minimum temperature which might be selected such as 78° F., member 33 can move to the position so that stop 40 engages stop 32 is the control point adjustment knob is moved counterclockwise below the selected minimum temperature. In the same manner, when changeover lever 23 is moved to the heat position, control point selection knob 14 must be turned to below a maximum heating temperature such as 72° F., and member 33 pivots clockwise so that stop 41 is in a position to engage stop 31 to limit the maximum temperature which can be selected for the heating operation. Obviously, the temperatures for both heating and cooling are selected by the design of the stops and their respective positions on shaft 15 so that a maximum heating temperature can be selected by single control point adjustment knob 14 and when single switch lever 23 is moved to the cooling position, a minimum cooling temperature can be selected by control point knob 14. Thus by design the operating ranges for heating or cooling could be either spaced apart with a "no operation" range therebetween as in the prior example, or could be overlapping if the heating range had heating upper limit of 75° and the cooling range had a lower cooling limit 70°.

The embodiments of the invention in which an exclusive property or right is claimed are defined as follows:

1. In a thermostat adapted for controlling heating and cooling apparatus comprising, a base member, temperature responsive switch means mounted on said base member, temperature control point adjustment means mounted on said base member and connected to adjust the control point temperature of said temperature responsive switch means, single lever changeover means mounted on said base member and connected to said temperature responsive switch means and adapted for selectively connecting either heating apparatus or cooling apparatus to said temperature responsive switch means, temperature control point limit means connected to said temperature control point adjustment means, first means connecting said single lever changeover means to said limit means to limit the range of movement of said control point adjustment means to a first range when said lever is in the heating position and to a second range when said lever is in the cooling position, said control point adjustment means has a knob attached to a shaft mounted on said base to rotate said shaft to a selected position for selecting a temperature control point of said temperature responsive switch means, said limit means comprising a pair of stop members mounted on said shaft, a pivotal stop member mounted on said base member, and said first means comprising a connection between said single lever to said pivotal stop member to select said first or said second range of operation by positioning said pivotal stop member to selectively engage one of said pair of stop members.

2. In a thermostat adapted for controlling heating and cooling apparatus comprising, a base member, temperature responsive switch means mounted on said base member, temperature control point adjustment means mounted on said base member and connected to adjust the control point temperature of said temperature responsive switch means, single lever changeover means mounted on said base member and connected to said temperature responsive switch means and adapted for selectively connecting either heating apparatus or cooling apparatus to said temperature responsive switch means, temperature control point limit means connected to said temperature control point adjustment means, first means connecting said single lever changeover means to said limit means to limit the range of movement of said control point adjustment means to a first range when said lever is in the heating position and to a second range when said lever is in the cooling position, said temperature control point adjustment means is a shaft mounted on said base with a knob for selectively adjusting the rotary position of said shaft, said limit means is a first stop member attached to said shaft and a second member attached to said base and selectively cooperating with said first stop member, and said first means connecting said changeover means to said second member to select one of said ranges upon movement of said single changeover lever means in first or second position.

3. The invention of claim 2 wherein said first stop member has first and second stop surfaces spaced apart by an amount depending upon the temperature of said first and second range, and said second member being U-shaped to pivot about its central portion so that one or the other of its extremities engages said first or second stop surface depending on the position of said changeover means.

4. The invention of claim 3 wherein said stop member comprises a raised stop surface between said first and said second stop surface to be engaged by said one or said other of the extremities of said second member to limit said single lever changeover means from being moved to a heating position when the control point adjustment means is set in said second range and to limit said single lever changeover means from being moved to a cooling position when the control point adjustment means is set in said first range.

5. In a thermostat adapted for controlling heating and cooling apparatus comprising, a base member, temperature responsive switch means mounted on said base member, temperature control point adjustment means mounted on said base member and connected to adjust the control point temperature of said temperature responsive switch means, single lever changeover means mounted on said base member and connected to said temperature responsive switch means and adapted for selectively connecting either heating apparatus or cooling apparatus to said temperature responsive switch means, temperature control point limit means connected to said temperature control point adjustment means, first means connecting said single lever changeover means to said limit means to limit the range of movement of said control point adjustment means to a first range when said lever is in the heating position and to a second range when said lever is in the cooling position, a cover mounted on said base member, said limit means has a removable tap cooperating with said cover for holding said limit means in a neutral position to allow for movement of said temperature control point adjustment means in said first and second range when said cover is in place.

6. In a thermostat adapted for controlling heating and cooling apparatus comprising, a base member, temperature responsive switch means mounted on said base member, temperature control point adjustment means mounted on said base member and connected to adjust the control point temperature of said temperature responsive switch means, single lever changeover means mounted on said base member and connected to said temperature responsive switch means and adapted for selectively connecting either heating apparatus or cooling apparatus to said temperature responsive switch means, temperature control point limit means connected to said temperature control point adjustment means, first means connecting said single lever changeover means to said limit means to limit the range of movement of said control point adjustment means to a first range when said lever is in the heating position and to a second range when said lever is in the cooling position, a subbase member attached to said base member, said changeover means comprising a single lever attached to said subbase member and a switch means controlled thereby, and said first means comprising a link member between said limit means and said single lever.

7. The invention of claim 6 wherein said limit means comprises a stop member pivoted on said base member and connected by said link member to said single lever, and a first and second stop member associated with said temperature control point adjustment means to limit the range of movement of said adjustment means to a first range when said single lever is in the heating position and to a second range when said single lever is in the cooling position.

* * * * *